US005848839A

United States Patent [19]

Savage, Jr.

[11] Patent Number: 5,848,839

[45] Date of Patent: Dec. 15, 1998

[54] LED SEALING LENS CAP AND RETAINER

[76] Inventor: John M. Savage, Jr., 538-B Via De La Valle, Solana Beach, Calif. 92075

[21] Appl. No.: 833,575

[22] Filed: Apr. 7, 1997

[51] Int. Cl.[6] ..... F21V 29/00

[52] U.S. Cl. ..... 362/267; 362/249; 362/800; 362/310

[58] Field of Search ..... 362/249, 800, 362/310, 226, 267; 277/212 F, 212 C

[56] References Cited

U.S. PATENT DOCUMENTS

| | | | |
|---|---|---|---|
| 2,001,636 | 5/1935 | Sward | 277/212 F |
| 2,670,976 | 3/1954 | Owen | 277/212 F |
| 2,831,737 | 4/1958 | Jacoby | 277/212 F |
| 2,967,743 | 1/1961 | Howe, Jr. | 277/212 F |
| 3,199,879 | 8/1965 | Fleming | 277/212 F |
| 3,611,360 | 10/1971 | Bailey | 362/226 X |
| 3,887,803 | 6/1975 | Savage, Jr. . | |
| 3,913,928 | 10/1975 | Yamaguchi | 277/212 F |
| 4,035,681 | 7/1977 | Savage, Jr. . | |
| 4,195,330 | 3/1980 | Savage, Jr. . | |
| 4,398,240 | 8/1983 | Savage, Jr. . | |
| 4,402,110 | 9/1983 | Savage, Jr. . | |
| 4,423,526 | 1/1984 | Izzi, Sr. | 277/212 F |
| 4,471,414 | 9/1984 | Savage, Jr. . | |
| 4,491,900 | 1/1985 | Savage, Jr. . | |
| 4,529,212 | 7/1985 | Beckmann | 277/212 F |
| 4,712,163 | 12/1987 | Oxley | 362/800 X |
| 4,727,648 | 3/1988 | Savage, Jr. . | |
| 5,066,889 | 11/1991 | Edwards | 362/800 X |
| 5,068,771 | 11/1991 | Savage, Jr. . | |
| 5,171,024 | 12/1992 | Janocko | 277/212 C |
| 5,193,099 | 3/1993 | Chou . | |
| 5,283,802 | 2/1994 | Hsiung . | |
| 5,368,503 | 11/1994 | Savage, Jr. . | |
| 5,440,468 | 8/1995 | Savage, Jr. | 362/800 X |
| 5,440,658 | 8/1995 | Savage, Jr. . | |
| 5,463,502 | 10/1995 | Savage, Jr. | 362/226 X |
| 5,466,174 | 11/1995 | Savage, Jr. . | |

*Primary Examiner*—Ira S. Lazarus
*Assistant Examiner*—Nhat-Hang H. Lam
*Attorney, Agent, or Firm*—William W. Haefliger

[57] ABSTRACT

An LED sealing lens cap, comprising in combination a lens cap body defining a recess to forwardly receive an LED, a shoulder on the body to face rearwardly toward a mounting panel, and a seal carried on the body to face outwardly, and located proximate the shoulder.

9 Claims, 6 Drawing Sheets

LED SEALING LENS CAP AND RETAINER

BACKGROUND OF THE INVENTION

This invention relates generally to light emitting devices and apparatus; more specifically, it concerns the installation or mounting of such devices to overcome prior problems and difficulties.

In the past, LEDs (light emitting diodes) have been permanently mounted within housings, and the latter were in turn attached or mounted to display panels. The construction was such that removal and replacement of the diodes was made quite difficult. U.S. Pat. No. 3,887,803 disclosed one way in which to more readily remove a diode from its housing; however, such removal necessitated prior detachment of a lens cap. Also, ready removal of the housing itself from the display panel remained a problem. Another mounting assembly was disclosed in U.S. Pat. No. 5,440,468.

SUMMARY OF THE INVENTION

Basically, an LED sealing lens cap is provided, and comprises, in combination:

a) a lens cap body defining a recess to forwardly receive an LED, b) an outwardly projecting shoulder on the body to face rearwardly toward a mounting panel, c) and a seal carried on the body to face outwardly, and located proximate said shoulder.

As will be seen, the seal typically comprises a thin layer extending about the lens cap body, to extend within an opening or bore in the mounting panel, whereby the seal layer sealingly engages that opening or bore.

A further object is to provide a sealing surface or layer that consists of a combination elastomer and plastic material; and the lens cap body typically consists of polycarbonate.

Yet another object is to provide a retainer received on and gripping the lens cap body, in forwardly spaced relation to the seal; and the retainer is typically annular to provide gripping force transmitted uniformly to provide uniform sealing engaged with the panel bore. Lens body gripping force is typically provided by serrations on the retainer and grippably engaging the lens cap body.

A further object is to provide a panel through opening into which the seal is closely received, and wherein the retainer and the shoulder retain the panel therebetween.

These and other objects and advantages of the invention, as well as the details of an illustrative embodiment, will be more fully understood from the following specification and drawings, in which:

DRAWING DESCRIPTION

DETAILED DESCRIPTION

Figure 7:
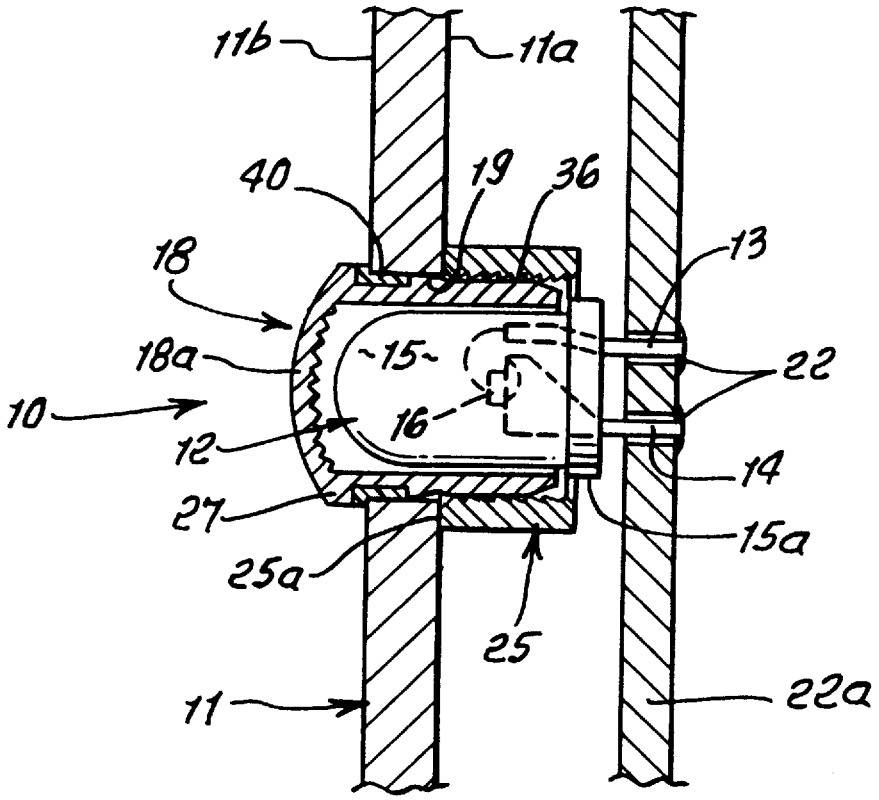
FIG. 7 is a section showing the FIG. 6 components in assembled relation.
Figure 8:
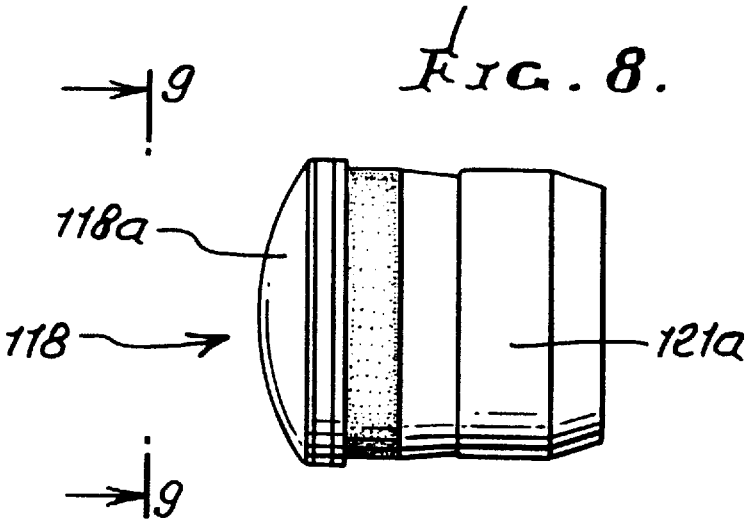
FIG. 8 is a side elevation showing a lens cap with moisture seal.
Figure 9:
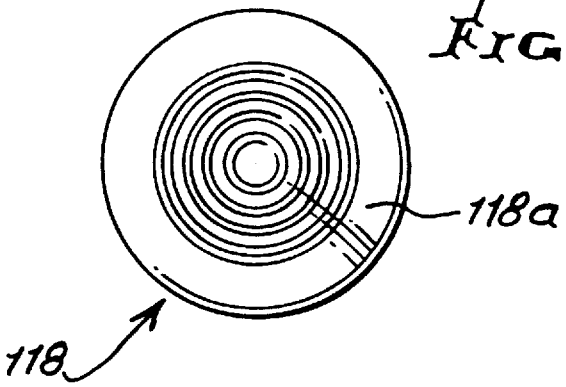
FIG. 9 is an end elevation taken on lines 9—9 of FIG. 8.
Figure 10:
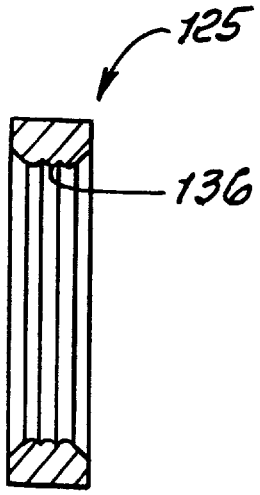
FIG. 10 is a section showing a retainer to be assembled on the FIG. 8 lens cap.

The light emitting diode assembly 10 seen in FIG. 7 is attached to display panel 11. The LED 12 includes terminals 13 and 14 projecting rearwardly from housing 15, and also within the latter at 13*a* and 14*a*. A luminous chip 16 defines the light-emitting zone of the LED. The terminals 13 and 14 may for example connect to circuitry 22 on a circuit board 22*a*, that carries the LED 12.

Figure 2:
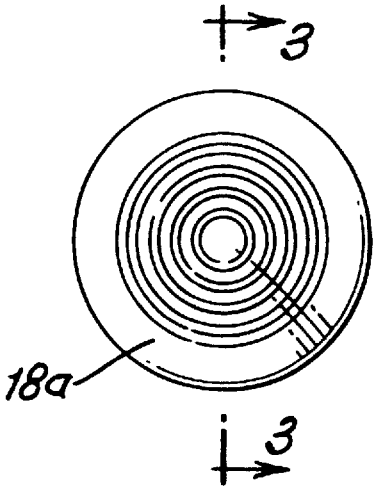
FIG. 2 is an end view taken on lines 2—2 of FIG. 1.
Figure 1:
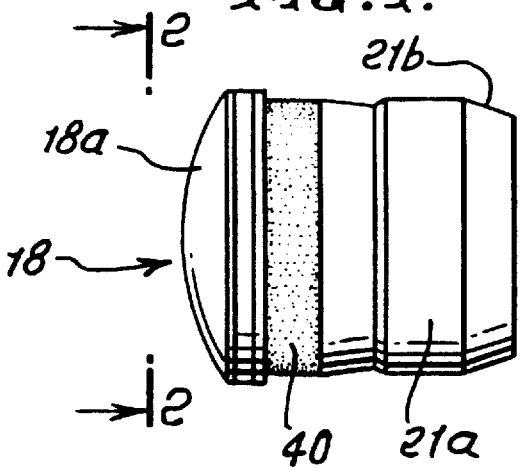
FIG. 1 is a side elevation showing a lens cap incorporating a moisture seal.
Figure 3:
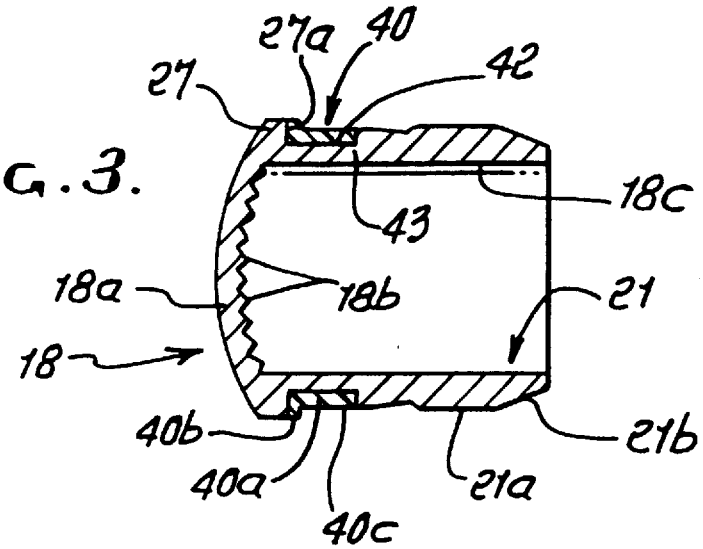
FIG. 3 is a section taken on lines 3—3 of FIG. 2.
Figure 4:
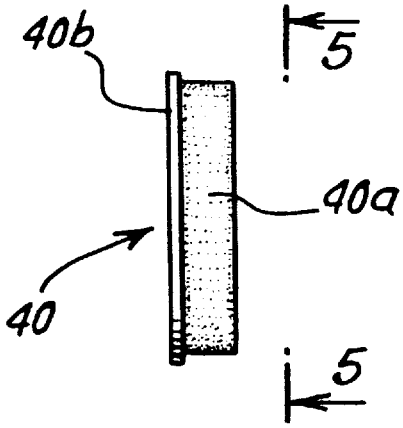
FIG. 4 is a side elevation showing the moisture seal.
Figure 5:
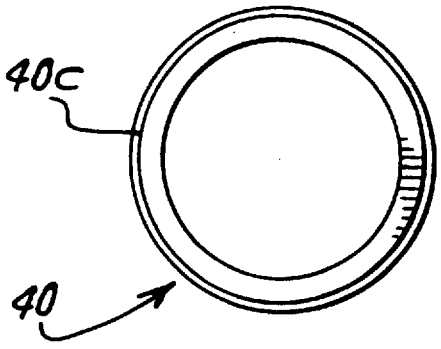
FIG. 5 is an end elevation taken on lines 5—5 of FIG. 4.
Figure 6:
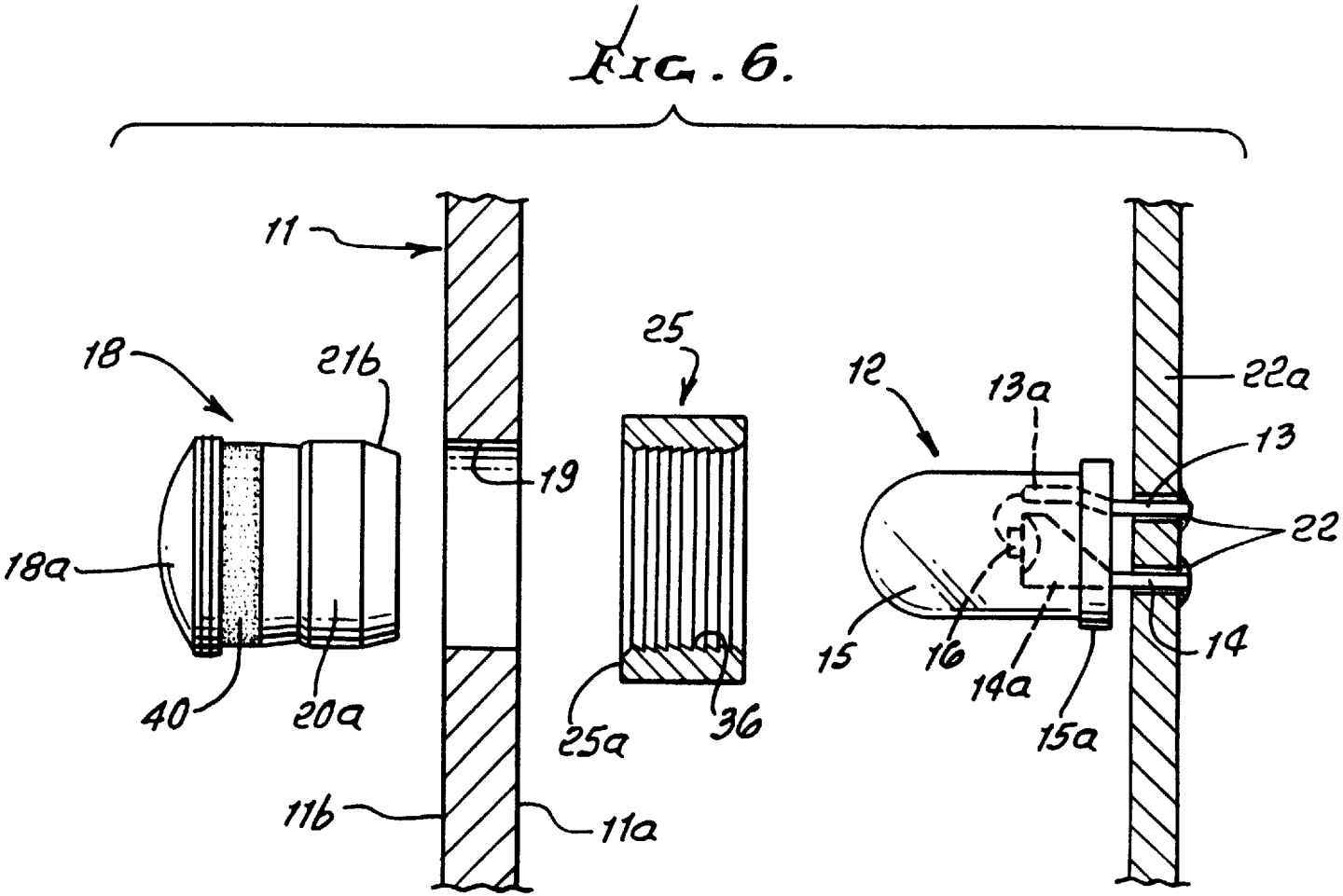
FIG. 6 is an exploded side elevation partly in section, showing components of an assembly.

The assembly also includes a lens cap 18 receiving the diode. The lens cap has a translucent or transparent lens 18*a* that projects axially at the front side of the panel, and the cap and diode 12 project axially forwardly through a cylindrical bore 19 forming an opening in the panel 11. Lens 18*a* has annular light diffusing serrations 18*b*. The cap has a rearward portion 21 defining a cylindrical surface 21*a* and a rearwardly tapered annular surface 21*b*, as better seen in FIG. 3.

Retention of the lens cap 18 to the panel 11 is assured by a retainer engaging the cap surface 21*a*. As shown, the retainer preferably comprise a ring 25 having a circumferentially serrated bore 36 in frictional engagement with surface 21*a*. FIG. 7 shows the forward end 25*a* of the retainer engaging the rear wall 11*a* of panel 11, for holding the lens cap in fixed axial position, attached to the panel 11. See in this regard lens cap shoulder 27*a* on a flange 27 proximate the front side 11*b* of the panel. Shoulder 27*a* is better seen in FIG. 3. Retainer serrated bore 36 has frictional, interference fit on cap surface 21*a*, to resist rearward displacement of the retainer relative to that surface. Such interference develops as the retainer bores cam outwardly on taper 21*b*. Accordingly, the lens cap locks to the panel in a position to receive the diode assembly into the cap bore 18*b*, on cap 18 locked to the panel, as shown in FIG. 7.

Diode assembly flange 15*a* on housing 15 is engageable with the rearward end 18*c* of the lens cap to limit forward reception of the diode assembly into the lens cap, and to establish desired spacing between the lens 18*a* and the forward end of the diode assembly translucent or transparent cylindrical housing 15. Retainer ring 35 prevents forward displacement of the lens cap in response to engagement of flange 15*a* against lens cap end 18*c*. The close fit of housing 15 in cap bore 18*b* blocks lateral movement of the diode assembly in the lens cap.

As seen in FIGS. 1 and 3–7, a seal 40 is carried by the lens cap body to face outwardly, the seal located proximate the flange 27 and shoulder 27*a*. The seal comprises a thin layer of sealing material extending annularly about the lens cap body, and may consist of an elastomer, or a combination molded elastomer and thermo-plastic material, having a Durometer between 35 and 100, such as "J-VON" a product of J-VON Company, or "EVA", a product of RIMFLEX Corporation. In this regard, the lens cap itself may typically consist of polycarbonate material, as does retainer 35.

More specifically, in the example shown, the preferred form of seal comprises an axially elongated portion 40*a*, and a radially extending flange portion 40*b* at the forward end of portion 40*a*, as best seen in FIGS. 1, 3, 4 and 5. The axially elongated portion 40*a* is retained in an annular groove 42 formed in the lens body 43, so that the outer surface 40*c* of the portion 40*a* extends cylindrically to closely fit and seal against (for example press against) panel bore 19, as when the seal radial portion 40*b* is compressed axially between panel wall 11*b* and cap flange shoulder 27*a*, upon assembly as shown in FIG. 7. Accordingly, moisture cannot gain rearward access to the circuit board and circuitry thereon, via the assembly of the lens cap to the panel 11.

Figure 11:
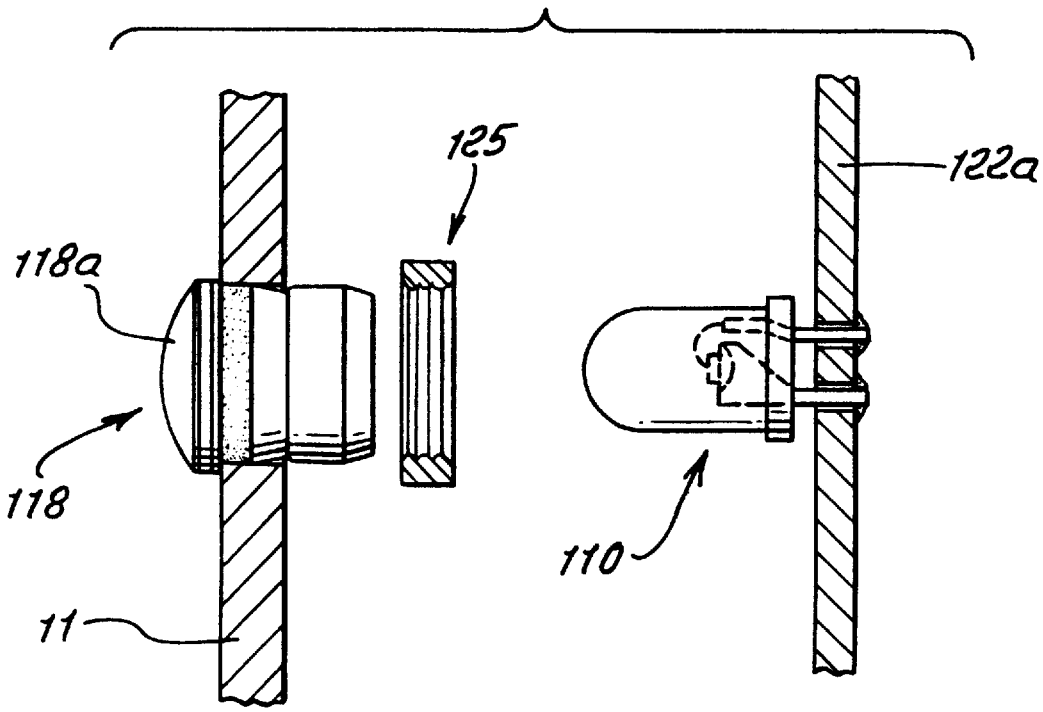
FIG. 11 is an exploded view showing the FIGS. 8 and 9 components together with a mounting panel and a printed circuit board to which an LED is connected.

FIGS. 8–11 show closely similar elements, including a lens cap 118, retainer 125, cap surface 121*a* grippable by the retainer bore serrations 136, and front lens 118*a*. The assembly is adapted to receive, i.e. assemble to a diode assembly 110, carried by a circuit board 122*a*, as seen in FIG. 11.

Figure 12:
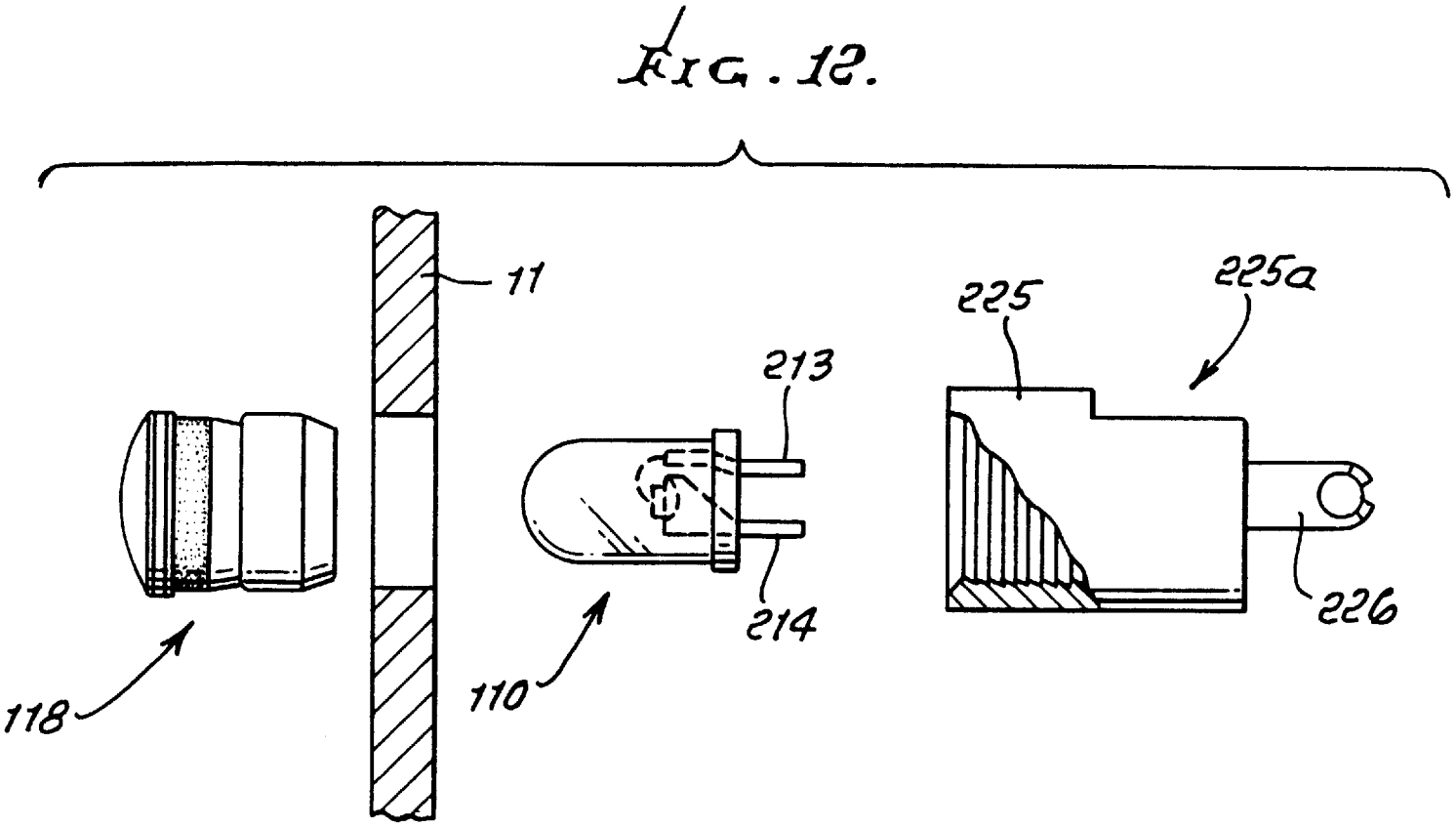
FIG. 12 is an exploded view showing the FIG. 8 lens cap, a mounting panel, an LED and a tubular connector.

FIG. 12 shows similar elements, excepting that the retainer 225 is integrated with a connector 225*a*, from which an electrical cable 226 extends. Diode assembly terminals 213 and 214 connect to terminals within the connector, and to which the cable electrically connects.

I claim:

1. An LED sealing lens cap, comprising in combination a) a lens cap body defining a recess to forwardly receive an LED, b) a shoulder on the body to face rearwardly toward a mounting panel, c) and a seal carried on the body to face outwardly, and located proximate said shoulder d) said seal being annular to extend about an axis, said seal having an axially elongated cylindrical portion and a radially extending flange portion adapted to he annularly compressed, e) said body forming an axially elongated groove into which substantially the entirety of said seal cylindrical portion is received.

2. The combination of claim 1 wherein said seal comprises a thin layer extending about the body.

3. The combination of claim 2 wherein said body consists of polycarbonate, and said seal consists of a combination elastomer and plastic material.

4. The combination of claim 1 wherein said seal consist of a combination elastomer and plastic material.

5. The combination of claim 1 including said panel defining a through opening into which said seal is closely received.

6. The combination of claim 1 including a retainer received on and gripping said body in forwardly spaced relation to said seal.

7. The combination of claim 6 wherein said retainer is annular, and has serrations engaging the body.

8. The combination of claim 7 including said panel defining a through opening into which said seal is closely received, and wherein said retainer and said shoulder retain the panel therebetween.

9. The combination of claim 7 wherein the lens cap body has a tapered end terminal over which the retainer is received with interference as the retainer is pushed forwardly onto said body.

* * * * *